US008596433B2

(12) United States Patent
Tauro

(10) Patent No.: US 8,596,433 B2
(45) Date of Patent: Dec. 3, 2013

(54) TRAVEL LUGGAGE TRANSPORTABLE EASILY ON STAIRS

(76) Inventor: Francesco Tauro, Bari (IT)

( * ) Notice: Subject to any disclaimer, the term of this patent is extended or adjusted under 35 U.S.C. 154(b) by 4 days.

(21) Appl. No.: 12/595,440

(22) PCT Filed: Apr. 14, 2008

(86) PCT No.: PCT/IT2008/000248

§ 371 (c)(1),
(2), (4) Date: Oct. 9, 2009

(87) PCT Pub. No.: WO2008/129577

PCT Pub. Date: Oct. 30, 2008

(65) Prior Publication Data

US 2010/0126815 A1 May 27, 2010

(30) Foreign Application Priority Data

Apr. 19, 2007 (IT) ..... BA2007A0035

(51) Int. Cl.
*A45C 5/14* (2006.01)

(52) U.S. Cl.
USPC ..... 190/18 R; 190/100; 190/109; 190/110; 190/117; 190/114; 206/316.1; 206/317; 206/320; 206/522; 206/570; D3/279; D3/283; D3/284; D3/285; D3/289

(58) Field of Classification Search
USPC ..... 190/18 R, 115, 18 A; 280/5.26, 47.2, 280/655, 47.315, 37
See application file for complete search history.

(56) References Cited

U.S. PATENT DOCUMENTS

| | | | | |
|---|---|---|---|---|
| 1,967,160 | A * | 7/1934 | Piotkin | 190/127 |
| 2,847,100 | A * | 8/1958 | Hotchner | 206/504 |
| 2005/0161893 | A2 * | 7/2005 | Darling | 280/30 |
| 2006/0213735 | A1 * | 9/2006 | Weinstein et al. | 190/18 A |
| 2007/0215424 | A1 * | 9/2007 | Mittleman | 190/18 A |
| 2008/0213735 | A1 * | 9/2008 | Shorr et al. | 434/178 |

FOREIGN PATENT DOCUMENTS

| | | | |
|---|---|---|---|
| DE | 29880021 | U1 | 3/2000 |
| DE | 102005001031 | A1 | 7/2006 |
| FR | 2850843 | A | 8/2004 |

* cited by examiner

*Primary Examiner* — Anthony Stashick
*Assistant Examiner* — Cynthia Collado
(74) *Attorney, Agent, or Firm* — Sughrue Mion, PLLC

(57) ABSTRACT

A handling baggage, constituted from a trolley or a suitcase, equipped of a couple of sliding shoes in elastic material, able to slide on stairs, facilitating the crossing.

12 Claims, 9 Drawing Sheets

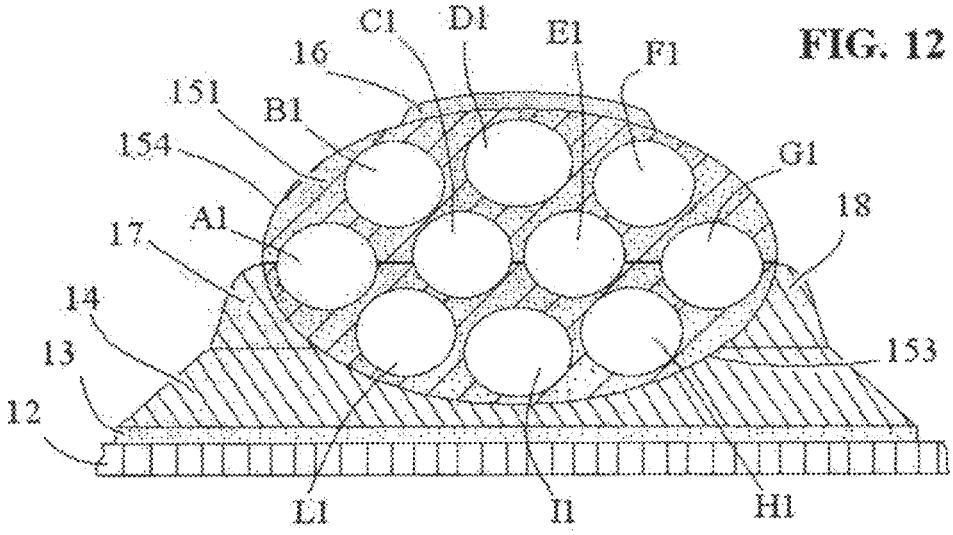
FIG. 12
FIG. 13
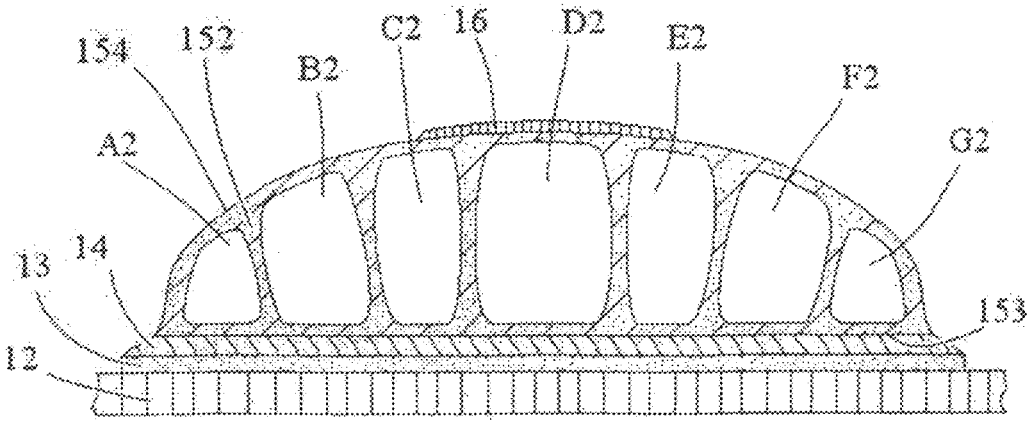

TRAVEL LUGGAGE TRANSPORTABLE EASILY ON STAIRS

CROSS-REFERENCE TO RELATED APPLICATIONS

This application is an U.S. national phase application under 35 U.S.C. §371 based upon co-pending International Application No. PCT/IT2008/000248 filed on Apr. 14, 2008. Additionally, this U.S. national phase application claims the benefit of priority of co-pending International Application No. PCT/IT2008/000248 filed on Apr. 14, 2008, and Italy Application No. BA2007A000035 filed on Apr. 19, 2007. The entire disclosures of the prior applications are incorporated herein by reference. The international application was published on Oct. 30, 2008 under Publication No. WO 2008/129577.

TECHNICAL FIELD

The present invention in general terms is applied to the field of the accessories and aid, in order to allow to cargoes or baggages generally, to exceed surfaces unconnected or stairs.

BACKGROUND ART

Sorts of accessories and systems are knew, able in making to go up or to come down stairs, avoiding jolting of the baggage.

These arrangement can be constituted from wheels constituted to they time from three or more smaller small wheels, or give of the crawler tracks, made in rubber generally, on which it comes arranged the cargo to transport.

These arrangement however introduce various problems and disadvantages caused in the first case to the effort demanded for the raising of the cargo in crossing stairs, the effort is rendered still more hard from its not constant intensity due to the alternate of the small wheels on which it burdens the weight of the baggage, in the passage climbing stair from one to another.

In the event instead to use the crawler tracks, this introduces the problem coming from the constructive imperfection of stairs, whose edges do not turn out never perfectly aligned, what that cause the crawler tracks in having to jolt, coming up or down from every step. Moreover these crawler tracks turn out not easy to transport as not light, let alone difficult to be produced in economic way on wide scale.

DISCLOSURE OF INVENTION

Main scope of the present invention is that one to exceed the various disadvantages and difficulties of use over evidenced by means of the elastic smooth sliding shoe, that they allow to slide on the edges of the stairs, adapting itself to the constructive imperfections of these last as their not perfect alignment.

An ulterior purpose of the present invention is that one to act as a protection element from hits in the event it comes installed on suitcases or luggage generally, for the small wheels of the suitcases particularly.

BRIEF DESCRIPTION OF DRAWINGS

Ulterior characteristics and advantages will turn out mainly obvious in the present description of a sort of preferred but not exclusive realization of suitcase and trolley with sliding shoe, illustrated as an example and not limiting with the aid of the attached tables and designs in which:

FIG. 12 and FIG. 13, illustrates the cross-sectional cracked one, geometrically obtained like in FIG. 5, but relative to ulterior examples of realization of the elastic member of sliding shoe.

BEST MODE FOR CARRYING OUT THE INVENTION

Figure 1:
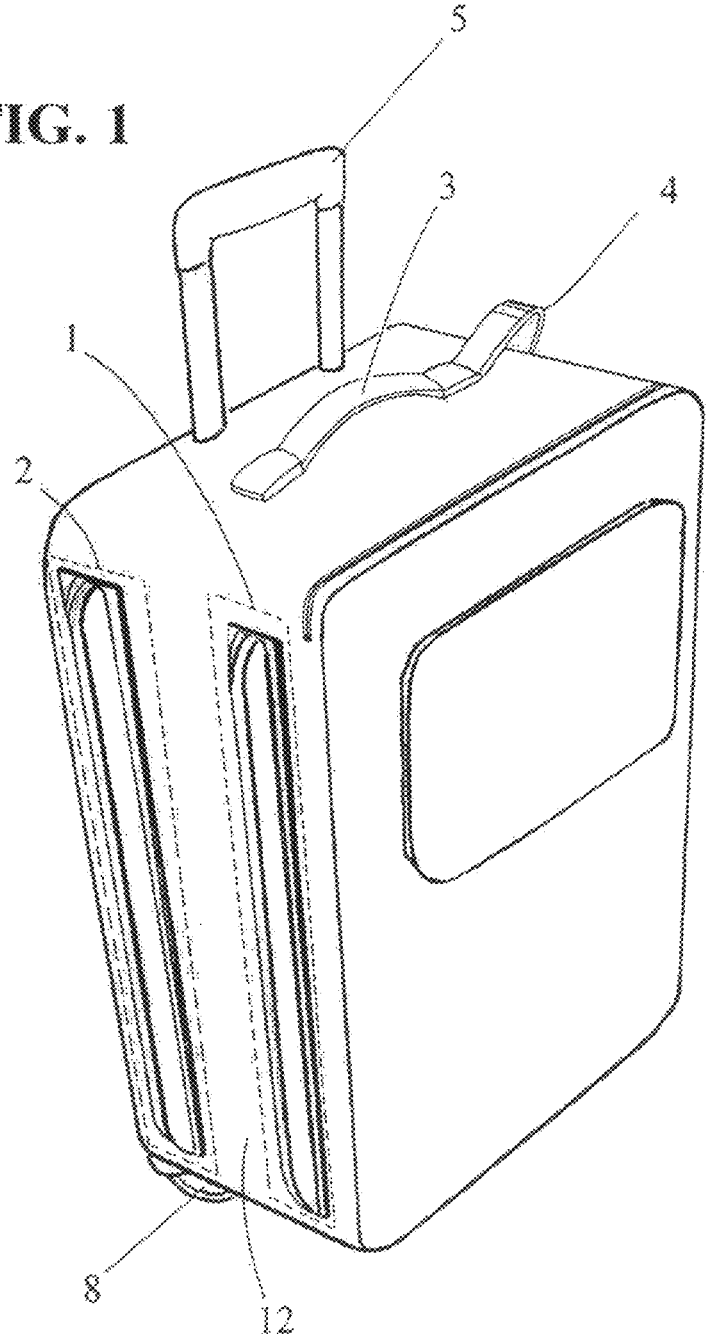
FIG. 1 illustrates a whole perspective sight of an example of realization of trolley, to whose side has been applied a couple of these saying sliding shoes, according to the invention.

In FIG. 1 an example of sliding shoe according to the invention are on the whole indicated by numbers 1 and 2, inside of the dotted lines there designed, on a side 12 of a trolley, an upper handle 3, an angular handle 4, an extensible posterior handle 5 and the small wheel 8, are moreover visible.

Figure 2:
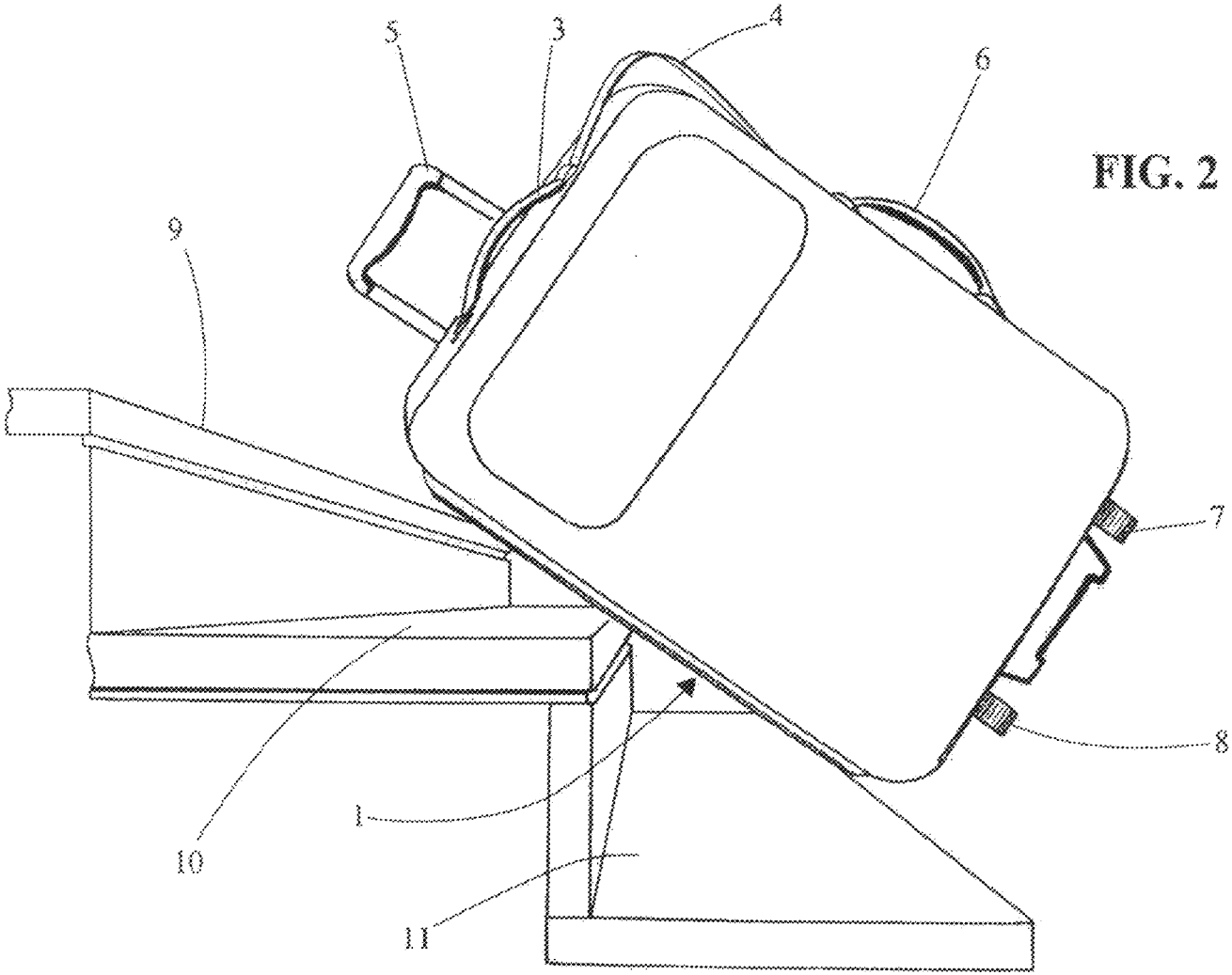
FIG. 2 illustrates a sight of same trolley, during the sliding on stairs.

In FIG. 2 they are represented, beyond to other elements already previously defined, a lateral handle 6, a small wheel 7, the stairs 9, 10 and 11.

Figure 3:
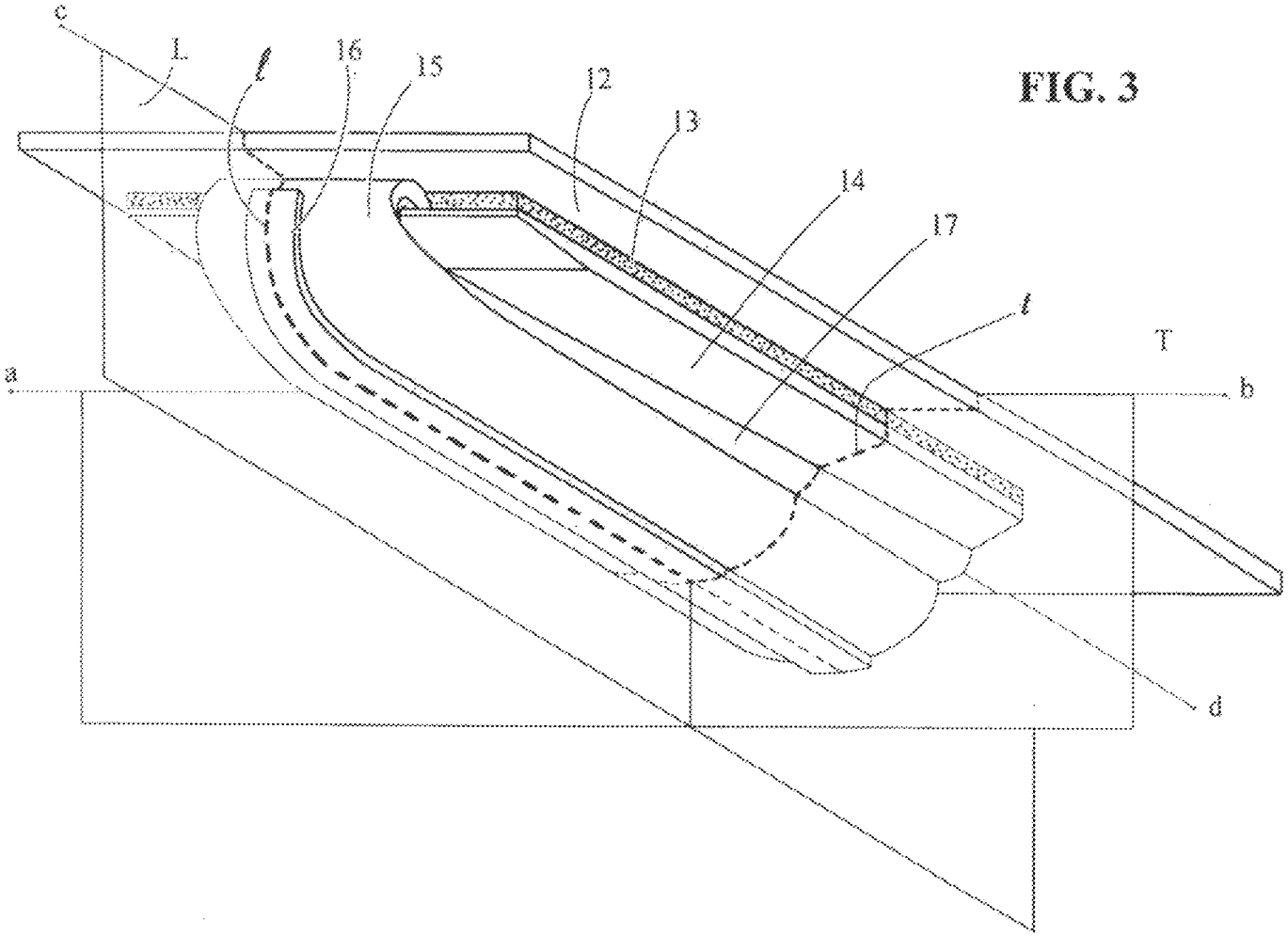
FIG. 3 illustrates a magnified sight of the extremity profile of this saying sliding shoe, comprised the section plans of the following Figures.

In FIG. 3 they are represented, beyond to other elements already previously defined, a portion of side 12 of the trolley, a layer of adhesive material 13, the base plate 14 of the sliding shoe, the elastic tubular member 15, a thin sheet 16, a shaped retaining element collar 17 of the base, the longitudinal plan L and that cross-sectional T, between orthogonal they, that they determine respective the traces "l" and "t", the directions of sight fixed by the points a-b and c-d.

Figure 4:
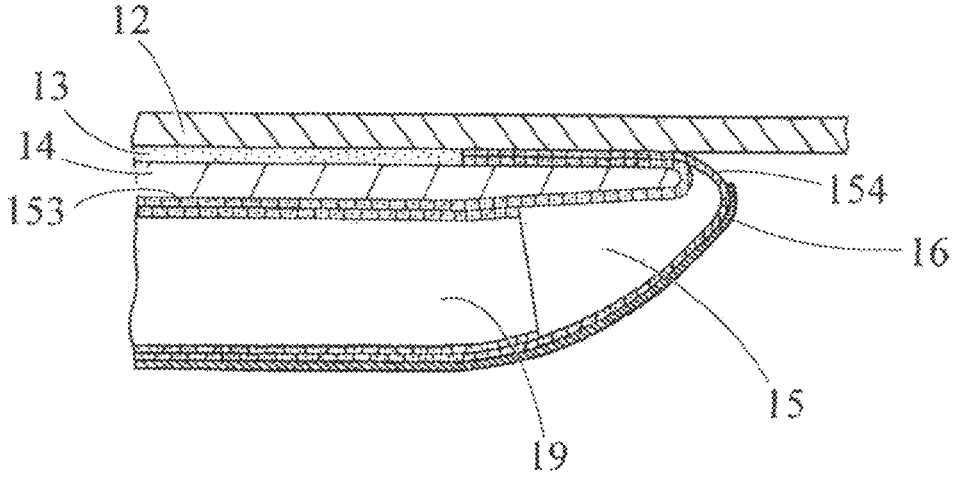
FIG. 4 illustrates the section of trace "l", obtained by means of the longitudinal plan L, designed in FIG. 3, watching the direction view a-b.

In FIG. 4 they are represented, beyond to other elements already previously defined, a inner tubular member to circular section 19, let alone pertaining to an elastic member 15, respectively the surface 153 of contact with the base plate 14 and the surface 154 of joining with the element 16.

Figure 5:
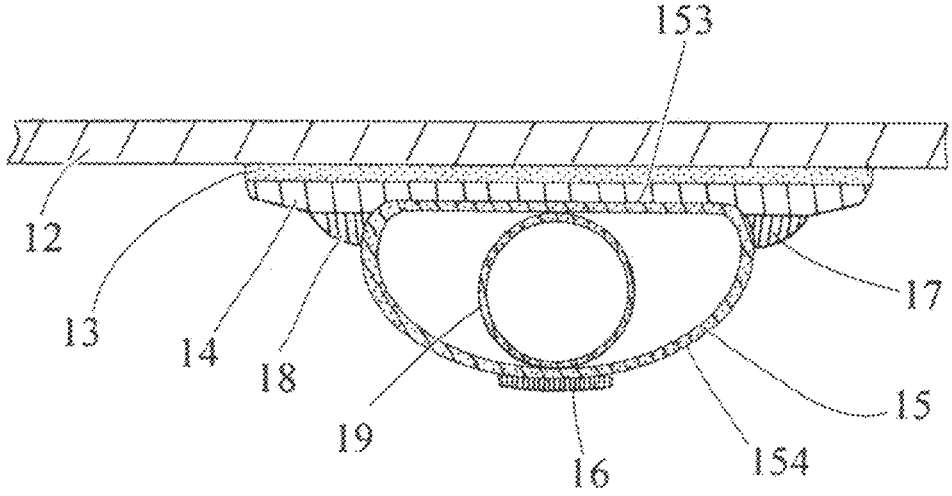
FIG. 5 illustrates the section of trace "t", obtained by means of the cross-sectional plan T, designed in FIG. 3, watching the direction view c-d.

In FIG. 5 they are represented, beyond to other elements already previously defined, a shaped retaining element collar 18 of base plate 14.

Figure 6:
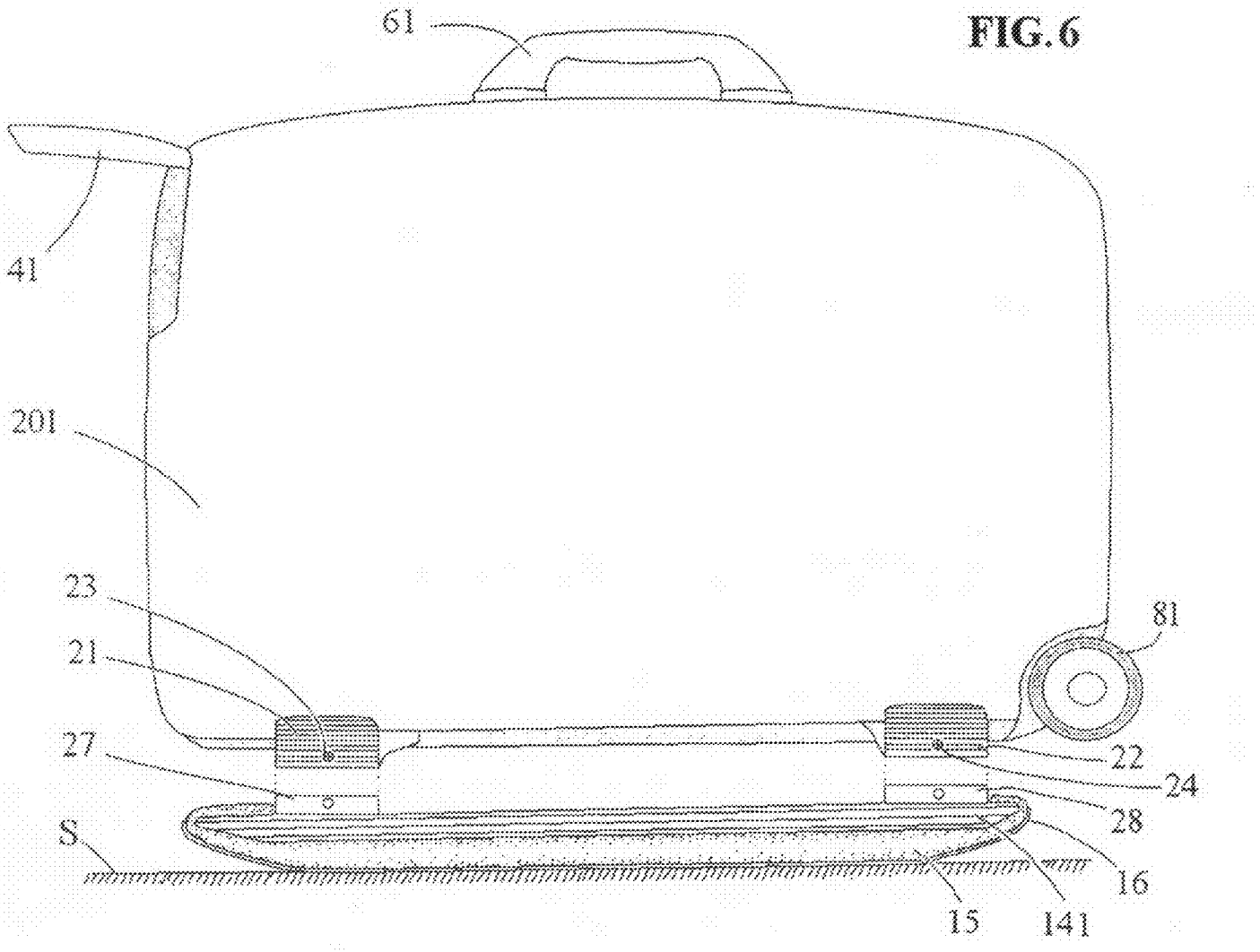
FIG. 6 illustrates a lateral sight of an example of realization of suitcase with small wheels, on whose bottom has been installed a removable sliding shoe according to the invention.

In FIG. 6 they are represented, beyond to other elements already previously defined, an upper handle of suitcase 61, a lateral release handle 41, a vertical lateral surface 201 of the suitcase, its two feet of support 21 and 22, the lives 23 and 24 of connection to that said feet of support, to elements 27 and 28 respectively, connected to base plate 141 of the sliding shoe, a small wheel 81, the ground of support S.

Figure 7:
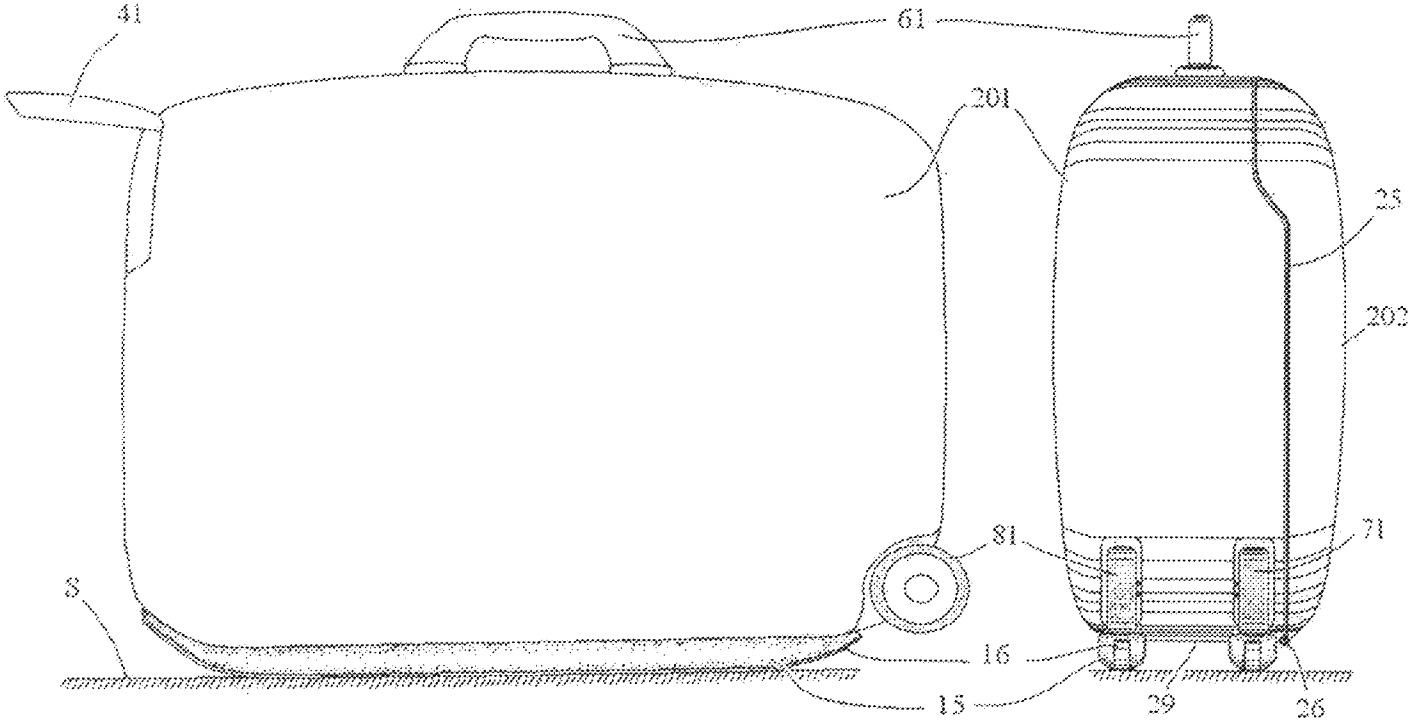
FIG. 7 illustrates a sight of two adjacent sides of an example of realization of suitcase with small wheels, on whose bottom has been installed a couple of shaped sliding shoes in order to join permanently, according to the invention.

In FIG. 7 they are represented, beyond to other elements already previously defined, vertical lateral surface 202 of the suitcase, the edge 25 of opening of the two superficial parts with 201 and 202, these last hinged ones by means of hinge 26, present on bottom 29 of the suitcase.

Figure 8:
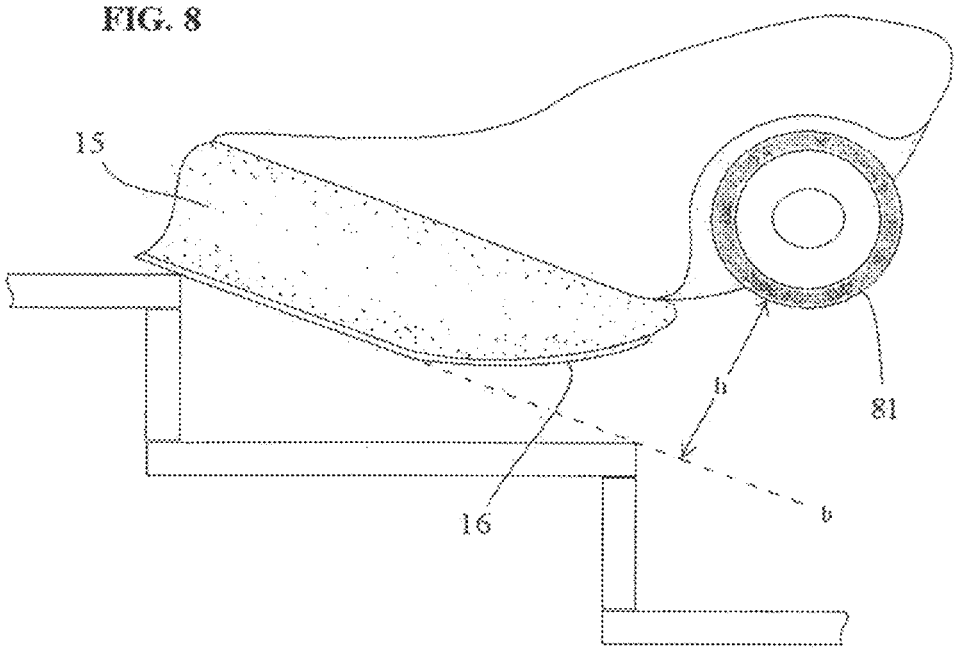
FIG. 8 illustrates a magnified detail of the zone with the small wheels of the example of suitcase of FIG. 7, in the action to slide on the stairs.

In FIG. 8 they are represented, beyond to other elements already previously defined, the separation h of small wheel 81 from the line b, of conjunction of the edges of two stairs.

Figure 9:
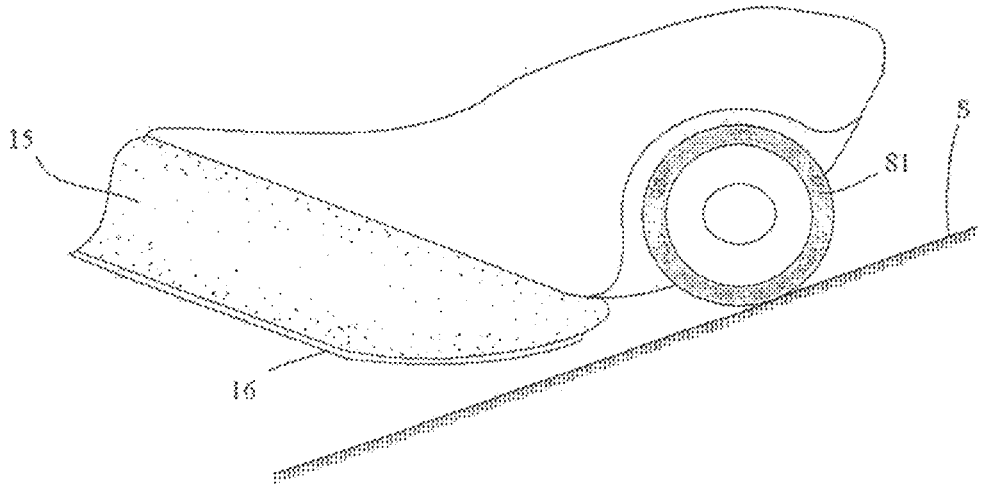
FIG. 9 illustrates a magnified detail of the zone with the small wheels of the example of suitcase of FIG. 7, in the action to move on the ground, by means of tumbling on these said small wheels.
Figure 10:
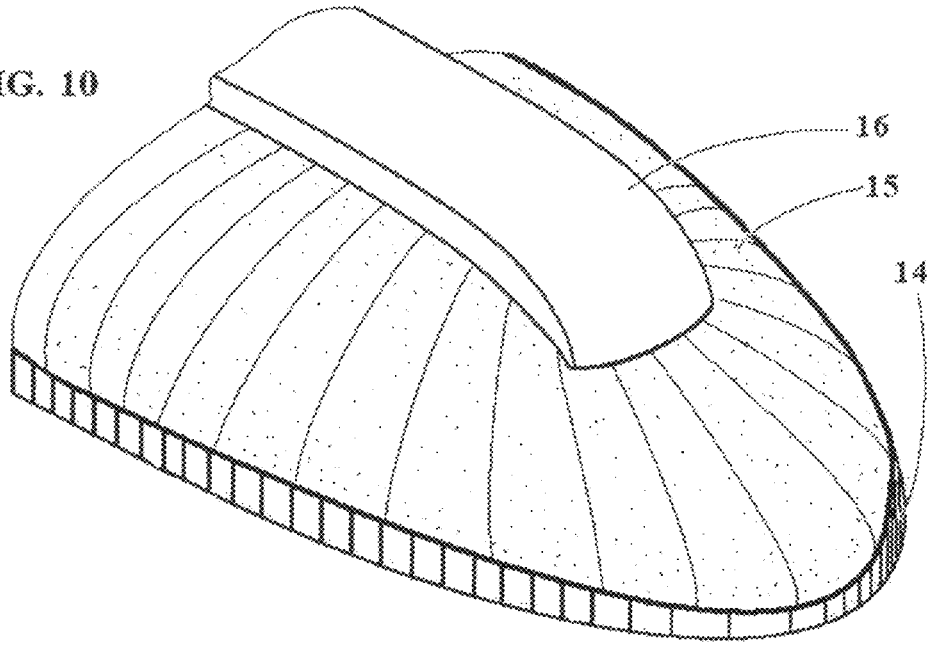
FIG. 10 illustrates an extremity of an ulterior realization example of sliding shoes according to the invention.

In FIG. 9 and FIG. 10 elements already previously defined are represented.

Figure 11:
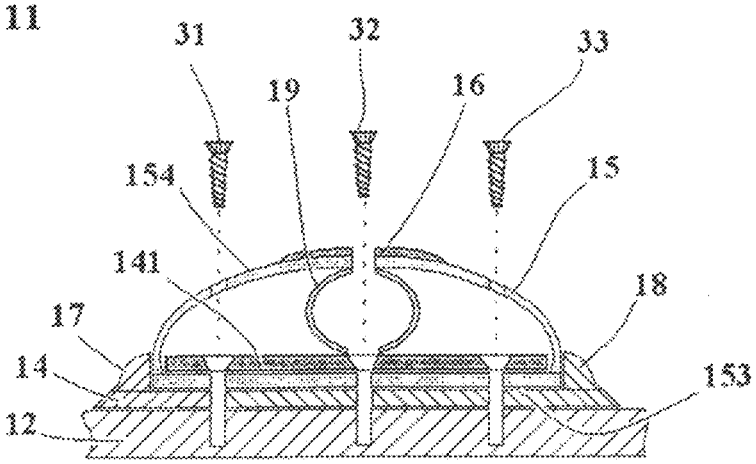
FIG. 11 illustrates the cross-sectional cracked one, geometrically obtained like in FIG. 5, but relative to an ulterior example of realization of the elastic member of sliding shoes and the base, elastic member containing a thin rigid bar like core.

In FIG. 11 they are represented, beyond to other elements already previously defined, a thin but rigid bar 141, placed inside the elastic member 15, lives 31, 32, 33.

In FIG. 12 they are represented, beyond to other elements already previously defined, the particular inner structure of the elastic member 151, comprising the inner cavities A1, B1, C1, D1, E1, F1, G1, H1, I1, L1.

In FIG. 13 they are represented, beyond to other elements already previously defined, the inner structure of the elastic member 152, comprising the prismatic cavities A2, B2, C2, D2, E2, F2, G2. Watching FIG. 2, I can make to slide the sliding shoe and with they the entire trolley, on the edges of stairs the 9, 10 and 11; if in coming down, I hold the handle 6, in going up it's more comfortable to hold the handle 4. The layer of adhesive material 13, visible in FIG. 3, is present for all the length of the sliding shoe, crushed between side 12 and the upper surface of base plate 14, except turning out absentee, looking at FIG. 4, only in the occupied space of the extremity of the member 15, where this last it comes withdrawn and crushed between the base plate 14 and the side 12.

Base 14 is upper to contact with this so defined adhesive layer 13 and lower connected in the central part to the elastic tubular member 15. This said base introduces a reduction of the thickness in proximity of the extremities, rounding off its inferior surface linearly, while that to contact with material 13 remains to line drawing. In FIG. 5 it is looked at like, laterally to the elastic member 15, from the inferior surface of said base plate 14, two collars 17 and 18 are risen, of section approximately to form of nail, uniform in order nearly all the length of the sliding shoe in the direction c-d, section that varied gradually in proximity of the extremities of the sliding shoe, it varied in form and is reduced in dimension until canceling itself, flattening itself completely on the extreme edge where the elastic member 15 comes wrapped to elbow around base plate 14.

Watching FIG. 3, FIG. 4 and FIG. 5, the elastic member 15, of elliptic section, constitutes the body of the sliding shoe for all its length, comes cross-sectionally limited from collars 17 and 18 in the lengthwise direction of flat L, finishes with its extremities crushed between the upper surface of base plate 14 and side 12 of the trolley, creating in said zone, a convergence of its free surface on that of base plate 14.

That said elastic member 15, is covered lower and partially from a thin sheet 16, that it comes to contact with the stairs, favoring the sliding and protect to avoid usury the elastic member 15.

In FIG. 4 and FIG. 5 a tubular element to circular section is indicated with 19 still elastic, inner and completely contained by the member 15, considering the case in which the external diameter of the element 19, result equal to the vertical inner diameter of the member 15.

In FIG. 6, I have an example of suitcase realization according to the invention, where the sliding shoe can be connected strongly to the feet of suitcase 21 and 22, by means of lives 23 and 24, which shoe to the elements 27 and 28 jointly ones with base 141 of the sliding shoe, in the inner saying cavity support feet.

In FIG. 7 I have an ulterior example of suitcase realization according to the invention, in which the elastic said members 15 sliding shoe, they have been connected directly to bottom 29 of the suitcase, shaped bottom so as to guarantee efficiency in the sliding at the same time and tumbling of small wheels 81 and 71.

In FIG. 8. the small wheel 81 of the suitcase of FIG. 7, is separated of a variable amount "h" from the edge of the stairs, ideally aligned along the line "b"; h depends on the relationship between raised and stamping of the stairs, not constant ratio due to constructive imperfections. Such imperfection, that it would make to jolt any rigid profile slides over sayings stairs, is compensated by elasticity of member 15, that it adapts the thin sheet 16, to the profile of the edges with which comes to contact.

In FIG. 9, when the suitcase of FIG. 7 comes raised and pulled angular handle 41, I have the tumbling of 81 on the ground S, without this last comes to contact with sheet 16; also in the hypothesis of contact between the ground S and sheet 16 during the motion of the suitcase, I have a contained friction due to be 16 smooth.

In FIG. 10 it is showed a magnified view of the profile of the elastic member 15 extremities, used for the example of realization of which to FIG. 7, FIG. 8 and FIG. 9.

In FIG. 11 I have an ulterior example of sliding shoe realization in which a thin but rigid bar 141, it is placed inside the elastic member 15 and by means of lives 31, 32, 33, realizes a resistant adhesion between the elastic member 15 and the surface of the element 12.

In FIG. 12 a realization is shown of the elastic member indicated with 151, with elliptical substantially external section, but with inner cylindrical cavities A1, B1, C1, D1, E1, F1, G1, H1, I1, L1 that they run for all its length from member 151, from an end to the other.

In FIG. 13 a realization approximately drop shaped is shown of the elastic member indicated with 152, where I have a substantially empty inner structure, but with of the ribbing that connect several points of the saying internal surface elastic member, and that they run for all its length from an end all other, defining the prismatic cavities A2, B2, C2, D2, E2, F2, G2.

From how much over described it is obvious that the sliding shoe realized according to the invention, the scopes of the invention catch up all, in particular the ability to being able to carry out said operations with an increment efficiency and facility of use regarding other products currently in the market. The invention is susceptible of numerous modifications and variations, re-entering in the inventive concept expressed in the attached claims, that are considered all protect equally.

The invention claimed is:

1. A travel baggage easily transportable on steps, said travel baggage comprising:

a prismatic form with at least a side-wall susceptible of being rested on a support, characterized in that said side-wall is equipped with at least one sliding shoe; and wherein said sliding shoe comprising at least a lengthened element including a base plate, and an elastic member, said elastic member having a surface and an opposite convex surface, said surface of said elastic member being fixed to said base plate, said base plate being fixed to said side-wall of said travel baggage, said convex surface being configured to slide on said support, said sliding shoe being connected to the side-wall by means of a mechanical connection, wherein said elastic member is a plan-convex tube containing an inner cylindrical piece in contact with the plan-convex tube.

2. A travel baggage easily transportable on steps, said travel baggage comprising:

a prismatic form with at least a side-wall susceptible of being rested on a support, characterized in that said side-wall is equipped with at least one sliding shoe; and wherein said sliding shoe comprising at least a lengthened element including a base plate, and an elastic member, said elastic member having a surface and an opposite convex surface, said surface of said elastic member being fixed to said base plate, said base plate being fixed to said side-wall of said travel baggage, said convex surface being configured to slide on said support, said sliding shoe further comprising a protection sheet elastically deformable, which is adherent to said convex surface.

3. A travel baggage easily transportable on steps, said travel baggage comprising:

a prismatic form with at least a side-wall susceptible of being rested on a support, characterized in that said side-wall is equipped with at least one sliding shoe; and wherein said sliding shoe comprising at least a lengthened element including a base plate, and an elastic member, said elastic member having a surface and an opposite convex surface, said surface of said elastic member being fixed to said base plate, said base plate being fixed to said side-wall of said travel baggage, said convex surface being configured to slide on said support, said sliding shoe being connected to the side-wall by means of a mechanical connection, wherein said elastic member contains inside a thin rigid bar clamping a section of the elastic member having the surface with the base plate.

4. A travel baggage easily transportable on steps, said travel baggage comprising:

a prismatic form with at least a side-wall susceptible of being rested on a support, characterized in that said side-wall is equipped with at least one sliding shoe; and wherein said sliding shoe comprising at least a lengthened element including a base plate, and an elastic member, said elastic member having a surface and an opposite convex surface, said surface of said elastic member being fixed to said base plate, said base plate being fixed to said side-wall of said travel baggage, said convex surface being configured to slide on said support, said sliding shoe being connected to the side-wall by means of a mechanical connection, wherein said elastic member is an elliptic cross-section body which is equipped with parallel cylindrical cavities.

5. A travel baggage easily transportable on steps, said travel baggage comprising:

a prismatic form with at least a side-wall susceptible of being rested on a support, characterized in that said side-wall is equipped with at least one sliding shoe; and wherein said sliding shoe comprising at least a lengthened element including abuse plate, and an elastic member, said elastic member having a surface and an opposite convex surface, said surface of said elastic member being fixed to said base plate, said base plate being fixed to said side-wall of said travel baggage, said convex surface being configured to slide on said support, said sliding shoe being connected to the side-wall by means of a mechanical connection, wherein said elastic member is a plan-convex cross-section body which is equipped with prismatic cavities being situated side by side.

6. The travel baggage according to claim 2, wherein said protection sheet, said elastic member and said base plate are provided with holes whose centers are aligned.

7. The travel baggage according to claim 4, wherein shaped retaining elements are present alongside the elastic member for jointly fixing the elastic member to the base plate.

8. The travel baggage according to claim 1, wherein said sliding shoe being tapered at ends thereof toward said side-wall.

9. A travel baggage easily transportable on steps, said travel baggage comprising:

a prismatic form with at least a side-wall susceptible of being rested on a support, characterized in that said side-wall is equipped with at least one sliding shoe; and wherein said sliding shoe comprising at least a lengthened element including a base plate, and an elastic member, said elastic member having a surface and an opposite convex surface, said surface of said elastic member being fixed to said base plate, said base plate being fixed to said side-wall of said travel baggage, said convex surface being configured to slide on said support, wherein a portion of said surface and said convex surface of said elastic member being wrapped to elbow around an end of said base plate so as to provide said surface and convex surface portions between said side-wall and said base plate.

10. The travel baggage according to claim 1, wherein said sliding shoe being connected to said side-wall by means of an adhesive.

11. The travel baggage according to claim 1, wherein said base plate of said sliding show being fixed to said side-wall by means of an adhesive.

12. The travel baggage according to claim 1, wherein said convex surface has a convex profile, at least a portion of said convex profile is parallel with a longitudinal axis of said elastic member.

* * * * *